United States Patent [19]

Growe et al.

[11] 4,218,780

[45] Aug. 26, 1980

[54] COSTUME HEADDRESSES

[75] Inventors: Glen H. Growe, Minneapolis; Robert L. Williams, Eden Prairie, both of Minn.

[73] Assignee: Philmon & Hart Laboratories, Incorporated

[21] Appl. No.: 12,888

[22] Filed: Feb. 16, 1979

[51] Int. Cl.[2] ..... A42B 1/24

[52] U.S. Cl. ..... 2/199; 2/206

[58] Field of Search ..... 2/185 R, 199, 171, 202, 2/205, 68, 206, 413

[56] References Cited

U.S. PATENT DOCUMENTS

| | | | |
|---|---|---|---|
| 180,903 | 8/1876 | McCarthy et al. | 2/199 X |
| 885,802 | 4/1908 | Sterrick | 2/206 |
| 2,593,188 | 4/1952 | Rikelman | 2/185 R X |
| 3,360,801 | 1/1968 | Parilla | 2/199 |
| 3,394,406 | 7/1968 | Bergens | 2/68 |
| 3,403,406 | 10/1968 | Weissberg | 2/68 |
| 3,676,879 | 7/1972 | Irie | 2/202 |
| 4,138,743 | 2/1979 | Elkins et al. | 2/202 X |

*Primary Examiner*—Peter P. Nerbun

*Attorney, Agent, or Firm*—James R. Cwayna

[57] ABSTRACT

A headdress or headcovering which includes an inflatable, helmet portion for positioning and retain the same upon one's head and an inflatable caricature portion attached to the helmet portion thereof. The helmet portion including a formable, resilient portion of sheet material to conform to the head of the user and having an inflatable peripheral portion to surround the lower edge thereof and hold the same about the user's head, the inflatable caricature portion including an attachment portion for attaching the same to the helmet portion and including a separate inflation unit for the inflatability of the same.

5 Claims, 5 Drawing Figures

COSTUME HEADDRESSES

FIELD OF THE INVENTION

This invention relates generally to hats and head coverings and more specifically to a head covering which includes a costume, inflatable upper portion for secure mounting onto the helmet or head covering portion, the helmet portion also including an inflatable portion for securely mounting mounting the same to the user's head.

Various decorative head coverings have been provided in the prior art. Such head coverings have included hats which simply are positioned on the user's head, hats which are held to the user's head with chin straps and the like and helmet devices which provide a certain degree of protection to the wearer. In the review of the prior art that the applicants' have conducted, they have failed to find a head covering, paricularly inclusive of a decorative combination that has revealed a helmet portion and an inflatable, decorative portion attached to the helmet portion, and more particularly wherein the helmet portion includes an inflatable section for fitting of the same to the head of the user.

It is therefore an object of applicants' invention to provide a costume headdress or the like which includes a head fitting portion and a decorative portion associated therewith, with both the head fitting portion and the decorative portion including means for inflating at least selected portions thereof.

It is a further object of applicants' invention to provide a costume headdress or the like which includes a decorative upper portion arranged for mounting on the user's head and for removeable attachment thereto which includes a form fitting portion for arrangement on the user's head.

It is still a further object of applicants' invention to provide a costume or decorative headdress or headpiece which, selectively may include, a hood or further clothing covering to provide an extension of the head covering and therefore provide a relatively complete costume.

It is still a further object of applicants' invention to provide a costume or decorative headdress or headpiece which includes means for selectively inflating portions thereof to enhance either the decorative and costume portions thereof or to provide a form fitting arrangement for the user's head.

These and other advantages and objects will more fully appear from the accompanying description made in connection with the accompanying drawings in which the same numeral or indicia is utilized to identify the same or similar parts throughout the several views, and in which.

Figure 1:
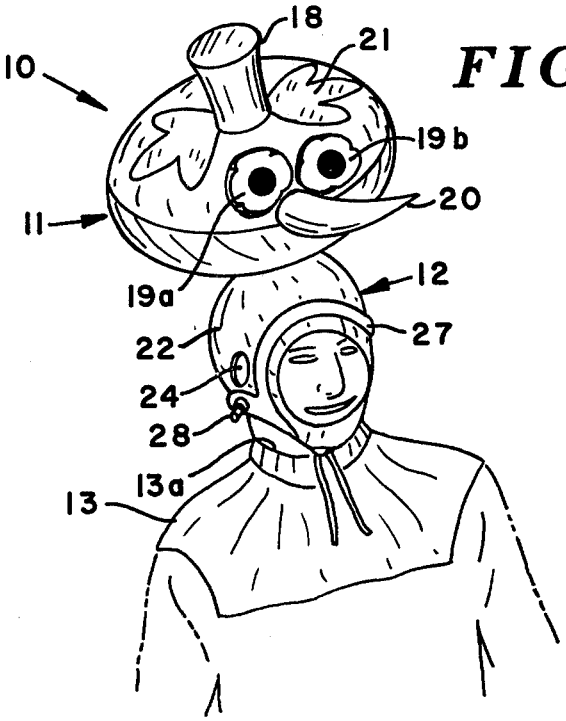
FIG. 1 is a perspective view of the headdress or costume head covering embodying the applicants' concepts, illustrating the same upon a user's head.
Figure 2:
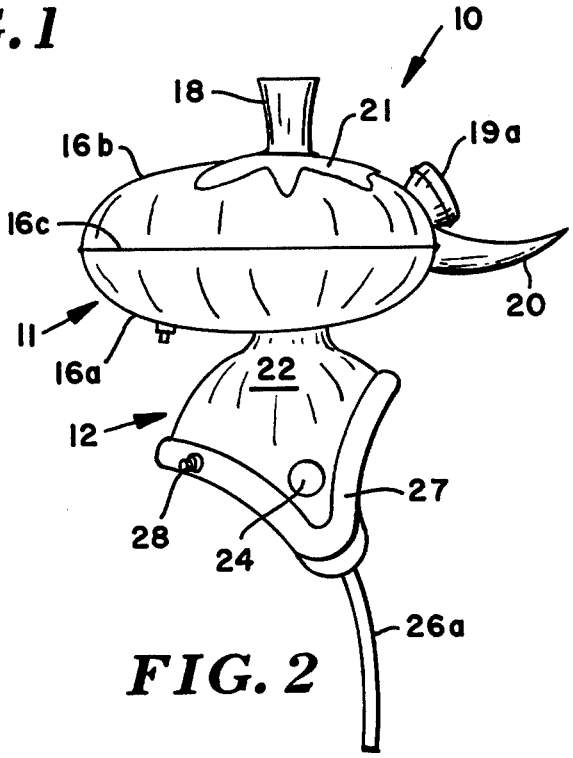
FIG. 2 is a general side view taken from the illustration of FIG. 1.
Figure 3:
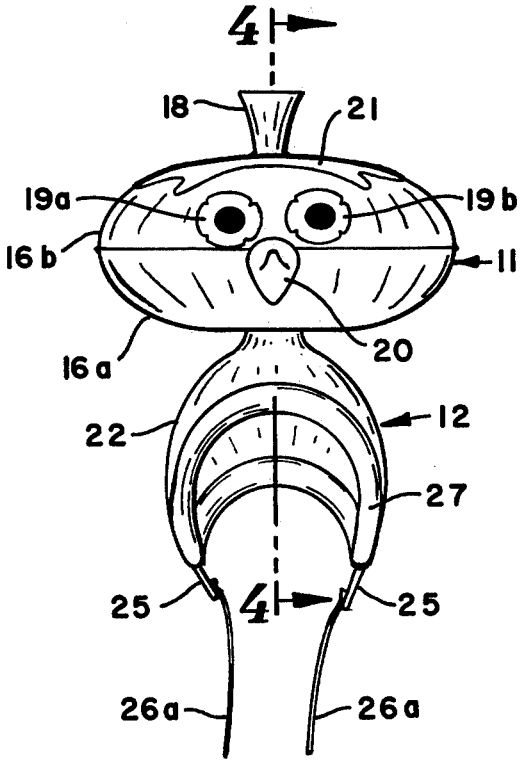
FIG. 3 is a front view of the device embodying the concepts of applicants' invention in inflated condition but not illustrating the same upon a user's head.

In accordance with the accompanying drawings, the decorative or costume headdress embodying the concepts of applicants' invention is generally designated 10 and is illustrated in several of the accompanying views as being worn by a child. In the particular form shown, the headdress includes an upper, inflatable decorative portion 11 and a lower, head attachment or helmet portion 12. An additional element may be provided for additional coverage or decoration and this includes a hood. Such hood may be provided in a variety of forms and as illustrated, this hood may take a shoulder covering form, designated 13 or a head covering form, designated 14 and particularly illustrated in FIG. 5.

The upper, inflatable portion 11 includes, in the form shown, a generally, sphere shaped element which provides an outer skin which may be formed by a pair of hemispherical elements **16*a*, 16*b* which are sealingly joined at a median line 16*c*. A valving member 17 is provided in the lower section 16*a*** for the admittance of air into the unit and such valves are common to the art.

For more decorative or costumed effect, the applicants have provided a plurality of appendages such as a top knot 18, a pair of eyes **19*a*, 19*b* and a nose 20. These appendages are, in the form shown, inflatable and air is delivered to each of the appendages by providing a passage, 18*a*, 19*c* and 20*a* through the skin of the hemispherical elements. These appendages must provide air tight assemblies and are, in the form shown, heat sealed to the provided spherical upper unit 11**.

It should be obvious that this upper, inflated element 11 may take any desired form or shape and although the applicants' have illustrated a pumpkin shape having eyes and a nose, the concept of applicants' device is not limited to this particular shape.

As an added decorative feature, the applicants' have provided a non-inflated element, such as a decorative leaf, the same being heat sealed to the upper unit 11, such leaf being designated 21. Such a showing illustrates that applicants' concept is not limited in its scope to the attachment of inflatables to the main body element but rather that non-inflatable elements may also be attached thereto to obtain the necessary decorative effect.

The lower, attachment or helmet portion 12 basically provides a means for securing the upper, decorative element 11 to the users head. In the form shown the helmet portion 12 includes a partial hemispherical skin portion 22 which is formed to receive the head of a user and which is, in the form shown, provided with an aperture 23 therethrough to permit and provide a sealing edge for attachment to a selected portion of the upper decorative portion 11. The skin portion is designed to be received on the forehead of the user and extend rearwardly and downwardly therefrom to extend below the ears of the user and apertures 24 are provided for the ears. The skin portion extends below the ears to a strap receiving portion 25 and straps **26*a*, 26*b*** are provided on the ends thereof.

Arranged around the lower periphery of the helmet skin portion 22 is an inflatable, generally circular cushioning and tightening element 27 is provided and a valve 28 is provided for the inflation thereof. This tightening element 27 will, upon inflation conform to the users head to positively secure the entire unit thereto and the cushioning will add to the comfort of the wearer. Obviously, means, such as heat sealing, must be used to join the cushioning and tightening element to the skin portion 22 of the helmet 12.

At this point, applicants' headdress could be considered to be complete and in a totally useable form. As an added decorative feature, applicants may provide a hood element to be worn therewith. Such hood has been previously designated as 13 in FIGS. 1 and 14 in FIG. 5.

In the form shown in FIG. 1, the hood 13 comprises a generally flat piece of material with an aperture 13*a* being formed generally centrally thereof to permit the same to be placed about the users neck and this aperture may be formed to provide an upstanding collar such that its upward extension will provide a relatively continuous arrangement with the helmet portion. Obviously, this material piece must be of a type that will form about the users shoulders and further, it should be understood that a cut could be made from one edge of the material to the neck aperture with means provided to close the same after it is put on.

In the form shown in FIG. 5, the hood 14 is designed to substantially cover the users head and to accomplish this arrangement an aperture 14*a* or a slit and aperture combination must be provided such that the hood 14 may be positioned above the helmet 12 portion and below the decorative portion 11. It should also be understood that the hood in this, or the first described form, could be made an integral part of the headdress by sealing the same thereto.

Figure 5:
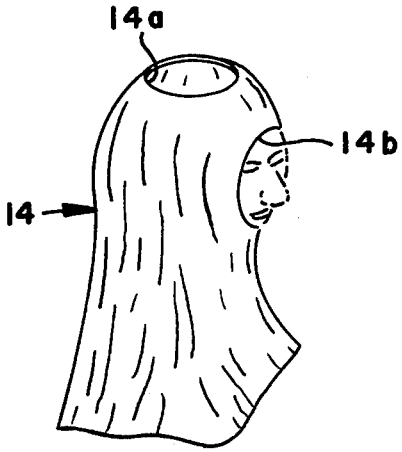
Figure 4:
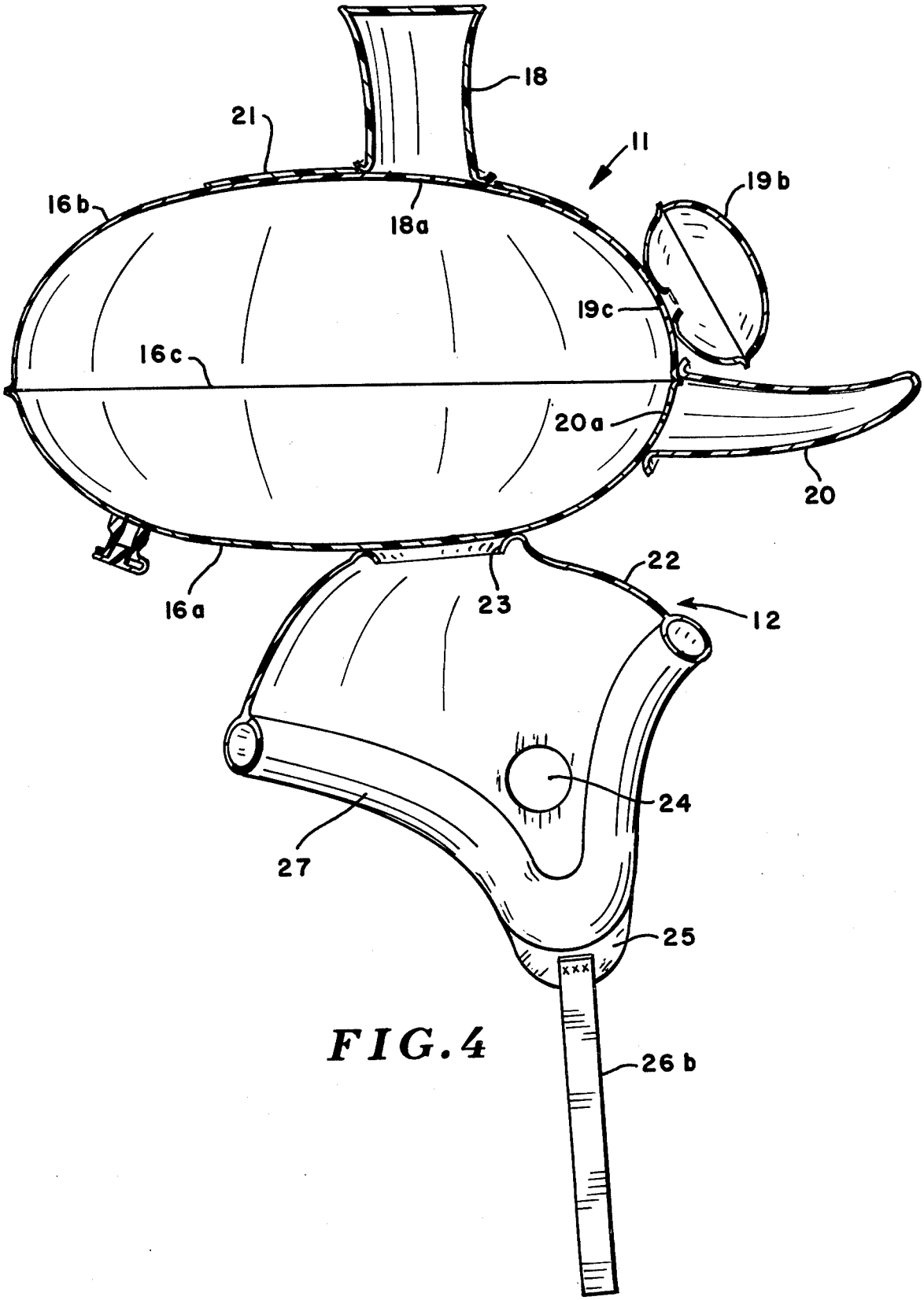
FIG. 4 is vertical section taken substantially along Line 4—4 of FIG. 3 and being drawn to an enlarged scale; and, FIG. 5 is a perspective view similar to FIG. 2 wherein a specific hood portion of the device is illustrated in an alternative position with regards to the device.

It should also be noted that, in the form shown for the hood 14 in FIG. 5 that a an opening 14*b* is provided for the users face.

With applicants' device, a decorative or costume head covering is provided that provides both a helmet portion for securing the same to the users head and a decorative portion secured to the helmet portion such that the decorative portion will be carried in a generally upright condition and position with respect to the helmet and the users head with added securing force and added comfort being provided for the user by the air filled, cushioning peripheral member provided on the helmet.

It should be obvious that applicants' head covering could be formed of various materials but that heat sealable plastics which are formable to conform to the users body are desirable and effective.

What we claim is:

1. A decorative head covering including:

a. an inflatable upper portion;

b. means to inflate said upper portion;

c. a head receiving portion defining a helmet and arranged and constructed to conform to the head of a person wearing the same and having a lower peripheral edge;

d. means for joining the inflatable upper portion to a selected portion of said head receiving portion;

e. at least one appendage sealingly connected to said upper inflatable portion for inflation therewith; and, f. and an inflatable member arranged at the lower peripheral edge of said helmet of said head receiving portion with means to inflate the same for conforming and securing the helmet to the users head.

2. The structure set forth in claim 1 and the lower peripheral edge of said helmet portion extending below the ears of the user and passages formed therethrough for passage of the users ears therethrough.

3. The structure set forth in claim 1 and strap means provided on the lower peripheral portion of said helmet portion.

4. The structure set forth in claim 1 and hood means having at least a central aperture therethrough for placing the same about selected portions of said head covering.

5. The structure set forth in claim 4 and a second aperture defined in said hood means for placement about the face of the user.

* * * * *